US010436225B1

(12) United States Patent
Freakes

(10) Patent No.: US 10,436,225 B1
(45) Date of Patent: Oct. 8, 2019

(54) METHODS AND APPARATUS FOR BALANCING ROTATABLE DEVICES

(71) Applicant: Anthony Freakes, Lawrenceville, NJ (US)

(72) Inventor: Anthony Freakes, Lawrenceville, NJ (US)

( * ) Notice: Subject to any disclaimer, the term of this patent is extended or adjusted under 35 U.S.C. 154(b) by 323 days.

(21) Appl. No.: 15/346,879

(22) Filed: Nov. 9, 2016

Related U.S. Application Data

(60) Provisional application No. 62/252,831, filed on Nov. 9, 2015.

(51) Int. Cl.

| | |
|---|---|
| ***F04D 29/00*** | (2006.01) |
| ***F04D 29/66*** | (2006.01) |
| ***F04D 29/28*** | (2006.01) |
| ***F04D 29/22*** | (2006.01) |

(52) U.S. Cl.
CPC ..... *F04D 29/662* (2013.01); *F04D 29/22* (2013.01); *F04D 29/281* (2013.01); *F04D 29/669* (2013.01)

(58) Field of Classification Search
CPC ..... F04D 29/669; F04D 29/662; F04D 29/22; F04D 29/281
USPC ..... 73/65.07
See application file for complete search history.

(56) References Cited

U.S. PATENT DOCUMENTS

| | | | | |
|---|---|---|---|---|
| 3,846,517 | A * | 11/1974 | Ross | B01F 3/04773 210/242.2 |
| 4,801,260 | A * | 1/1989 | Oles | B29C 49/36 425/451.5 |
| 6,053,033 | A * | 4/2000 | Kuhlmann | G01M 1/122 73/65.01 |
| 8,704,855 | B1 * | 4/2014 | Berme | A61B 5/1036 345/633 |
| 2007/0186626 | A1 * | 8/2007 | Latiri | A63B 60/42 73/65.01 |
| 2015/0186556 | A1 * | 7/2015 | Murota | G06F 17/50 703/1 |
| 2017/0350749 | A1 * | 12/2017 | Alonso Tabares | G01G 19/024 |

* cited by examiner

*Primary Examiner* — Max H Noori
(74) *Attorney, Agent, or Firm* — Timothy X. Gibson; Gibson & Dernier LLP

(57) ABSTRACT

An apparatus for locating a center of gravity of a workpiece and forming a bore in the workpiece, the apparatus including a housing having a base configured to support the apparatus on a surface, a mounting plate, an X-axis plate slidably disposed on a first side of the mounting plate opposite a second, base-facing side of the mounting plate, a Y-axis plate slidably disposed on the X-axis plate, a holder coupled to the side of the Y-axis plate opposite the X-axis plate, wherein the holder is configured and operable to receive and retain the workpiece, a securing device operable to releasably secure the workpiece in the holder, at least two distance sensors positioned adjacent the holder, an elongated tool mounted within the housing axially aligned with central apertures formed in each of the mounting plate, Y-axis plate and X-axis plate, wherein the elongated tool is operable to move reciprocally and rotatably, and motors operable to move each of the Y-axis plate, X-axis plate and elongated tool.

12 Claims, 10 Drawing Sheets

METHODS AND APPARATUS FOR BALANCING ROTATABLE DEVICES

CROSS-REFERENCE TO RELATED APPLICATIONS

This application claims the benefit of U.S. Provisional Patent Application No. 62/252,831 filed Nov. 9, 2015, the entirety of which is incorporated herein by reference.

FIELD OF THE INVENTION

The invention relates to rotatable devices and methods and apparatus for balancing such devices.

BACKGROUND

Many commercially available products such as leaf blowers, blenders, fans etc. use small motors having an impeller or propeller mounted to a rotor. Vibration in such devices can be unpleasant, and in some cases, cause injury to the operator or damage to the device itself when excessive. The vibration in such devices arises principally from rotational imbalance in the impeller or propeller assembly. For example, as the rotating assembly revolves at 15,000 rpm, any imbalance above about 0.6 gram inches causes unpleasant vibration.

SUMMARY OF THE INVENTION

Rotatable devices such as impellers and propellers are essential elements in apparatus such as hand-held blowers, blenders, fans and the like. The impellers and propellers may be made of various materials such as metal, plastic, ceramic, wood, etc. For example, in devices such as hand-held blowers/mulchers, a metal impeller may be employed so that leaf mulching can be performed. As a metal impeller is electrically conductive, it is required to have an insulating plastic hub, which insulates the metal impeller from the motor shaft. In many cases, this plastic hub is part of an assembly procedure. This means that the rotating assembly includes the motor rotor; the impeller, a retaining nut and, as in the case of the blower/mulcher, the plastic hub.

Therefore, at least three or four of the aforementioned components contribute to the rotational imbalance, but the final resultant imbalance is determined by the offset of the center of mass to the turning axis. For example, if the rotating assembly weighs 652 grams, in order to achieve an imbalance limit of 0.6 gram inches the center of mass must be no more than 0.00092" offset to the turning axis. This is a very tall order for ordinary mass-produced assemblies containing three or four independent components. Ideally, the entire rotating assembly should be balanced, but this is usually not practical. For example, in the case of blowers which also act as vacuums, the impeller becomes clogged with debris and requires cleaning, so it is frequently removed and reassembled. Also, sometimes the impeller is damaged, and has to be replaced. This means that the motor rotor assembly and the impeller are separately balanced.

Single plane imbalance evaluation and reduction is typically used in connection with devices which are short in their axial length compared to their diameter. Conveyance wheels (e.g., car tires/wheels), grinding wheels, propellers, and impellers fall into this category. Single plane imbalance in a device can be sensed by a machine which rotates the device while sensors placed at bearing supports sense loading changes. The machine may specify the compensation required in the single plane being evaluated.

Disclosed herein are methods and devices for sensing and reducing imbalance and hence vibration by locating a center of gravity of devices such as impellers and propellers and forming a bore in the device having an axis coincident with the center of gravity.

The principle of establishing balance is to align the pivot point, on which the object rests, with a vertical axis which aligns with the center of gravity of the object, and to use this position to establish the boring axis. Workpieces which are amenable to the presently disclosed methods and apparatus are usually disc shaped, in that they have an outer circular periphery and a central boss. Typical impellers and propellers and fans have this feature, and although the fins and vanes disturb the flatness, these features are symmetrical about the central axis about which the part rotates, and it is usually possible to adapt to the special shapes successfully.

Apparatus and methods disclosed herein are operable to define a center position of a bore axis in a controlled manner, and to closely guide boring tools to achieve a bore, which results in a balanced part. In principle, when a body has an external flat surface below its center of gravity, and the body is supported by a point, such as a sharp point, against that flat surface, the body will immediately tip towards the heavy side. In accordance with at least one aspect, methods disclosed herein depend on detecting the tipping action of a workpiece which is resting on a sharp point. Continued incremental readjustment of the workpiece relative to the sharp point in a direction which reduces the offset eventually results in passing the vertical center of gravity line and offsetting in the opposite direction, at which point, the workpiece tips in the opposite direction, therefore indicating that the center of gravity vertical line is within a distance, which is less than the increment adjusted. This then defines the position of the bore axis, if the increment adjusted is based on the imbalance limit specified.

Apparatus and tools disclosed herein permit drilling and reaming in the upward direction after the center of gravity of a workpiece is located. Because the tool used to locate the center of gravity is also used for boring operations, the tool is automatically in the precise location to conduct boring operations after the center of gravity is located.

In accordance with one or more embodiments, an apparatus for locating a center of gravity of a workpiece and forming a bore in the workpiece includes a housing, the housing including a first end forming a base configured to support the apparatus on a surface and a second, opposite end including a mounting plate with a central aperture, an X-axis plate with a central aperture and a first side, the X-axis plate first side slidably disposed on a first side of the mounting plate opposite a second, base-facing side of the mounting plate, a Y-axis plate with a central aperture and a first side, the Y-axis plate first side slidably disposed on a second, opposite side of the X-axis plate, a holder coupled to a second, opposite side of the Y-axis plate, wherein the holder is configured and operable to receive and retain the workpiece, a securing device operable to releasably secure the workpiece in the holder, at least two distance sensors mounted to the Y-axis plate and positioned adjacent the holder, an elongated tool mounted within the housing axially aligned with the central apertures of the mounting plate, Y-axis plate and X-axis plate, wherein the elongated tool is operable to move reciprocally and rotatably, a first motor operably engaged to the Y-axis plate and operable to move the Y-axis plate reciprocally along a first axis, a second motor operably engaged to the X-axis plate and operable to move the X-axis plate reciprocally along a second axis perpendicular to the first axis, a third motor operable to move the elongated tool reciprocally, and a fourth motor operable to rotate the tool.

In some embodiments the holder is formed in the shape of a ring and is rotatably coupled to the Y-axis plate.

The at least one securing device may include at least two clamping levers, wherein each of the at least two clamping levers is pivotably fixed at a first end to an upper surface of the holder and slidably coupled at a second end to a clamping lever aperture formed in the holder, wherein rotation of the holder in a first direction causes the clamping levers to simultaneously clamp the workpiece and rotation in an opposite direction causes the clamping levers to release the workpiece. The apparatus may include a fifth motor operable to rotate the holder.

The at least two distance sensors are in some embodiments laser sensors spaced apart and each positioned to measure a distance from the sensor to a periphery of the workpiece. The distance sensors are positioned to direct a laser beam downward toward and form a beam spot on the workpiece. The distance sensors may be positioned anywhere along the periphery of the holder. In some embodiments there are at least two distance sensors spaced apart 120 degrees around a periphery of the holder.

The elongated tool includes a first end having a pivot point, a threaded region disposed between the first end and a second end, and a polygonally-shaped cross-sectioned region disposed between the threaded region and the second end. The elongated tool threaded region is operably coupled to the third motor. The polygonally-shaped cross-sectioned region is operably coupled to the fourth motor. In some embodiments the elongated tool includes a plurality of drilling features, such as drill elements having various cross-sectional diameters, preferably graduated from smallest to largest progressing from the pivot point toward the opposite end, and a reaming element, wherein the drilling features are disposed between the first end and the threaded region.

The X- and Y-axis plates are movable laterally along the X-axis and Y-axis, respectively, to permit movement of the workpiece relative to the elongated tool to offset the workpiece an amount and in a direction which compensates a measured imbalance of the workpiece.

In accordance with further embodiments, methods are disclosed for locating a center of gravity of a workpiece employing the apparatus, the method including the steps of A) positioning a workpiece in the holder, B) setting a pivot point of the elongated tool at a position not in contact with the workpiece, C) setting the securing device in an unclamped position, D) raising the elongated tool so that the pivot point contacts the workpiece, causing the workpiece to tip toward an operator and away from the distance sensors, E) setting a lifting distance minimized and suited to the ability of the distance sensors to discern tipping, F) arranging and zeroing the distance sensors so that when the distance sensors are sensing downward, the distance sensors register the same reading when focused on a same level surface, wherein a straight line connecting the at least two sensors is aligned parallel to an X-axis;

G) determining whether readings of distances of the respective distance sensors, with respect to respective focused points, on a surface, proximal the outer periphery of a raised, imbalanced and tipped workpiece are unequal, and if so, lowering and clamping the workpiece, and proceeding to step H); if not, proceeding to step I), H) incrementing the workpiece along the X-axis, in a direction towards the distance sensor which recorded a lower distance reading than the other distance sensor, until both distance sensors are reading identical distances when the workpiece is raised and tipped, to establish the tipping direction is parallel to the Y-axis, I) lowering the elongated tool to lower the workpiece, J) securing the workpiece, K) incrementing the workpiece along the Y axis, either toward or away from the distance sensors depending on the direction of tipping away from the sensors;

L) when the sensors indicate that the tipping direction has changed, lowering the elongated tool, M) clamping the workpiece, and N) drilling the workpiece using the elongated tool.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE INVENTION

Figure 1:
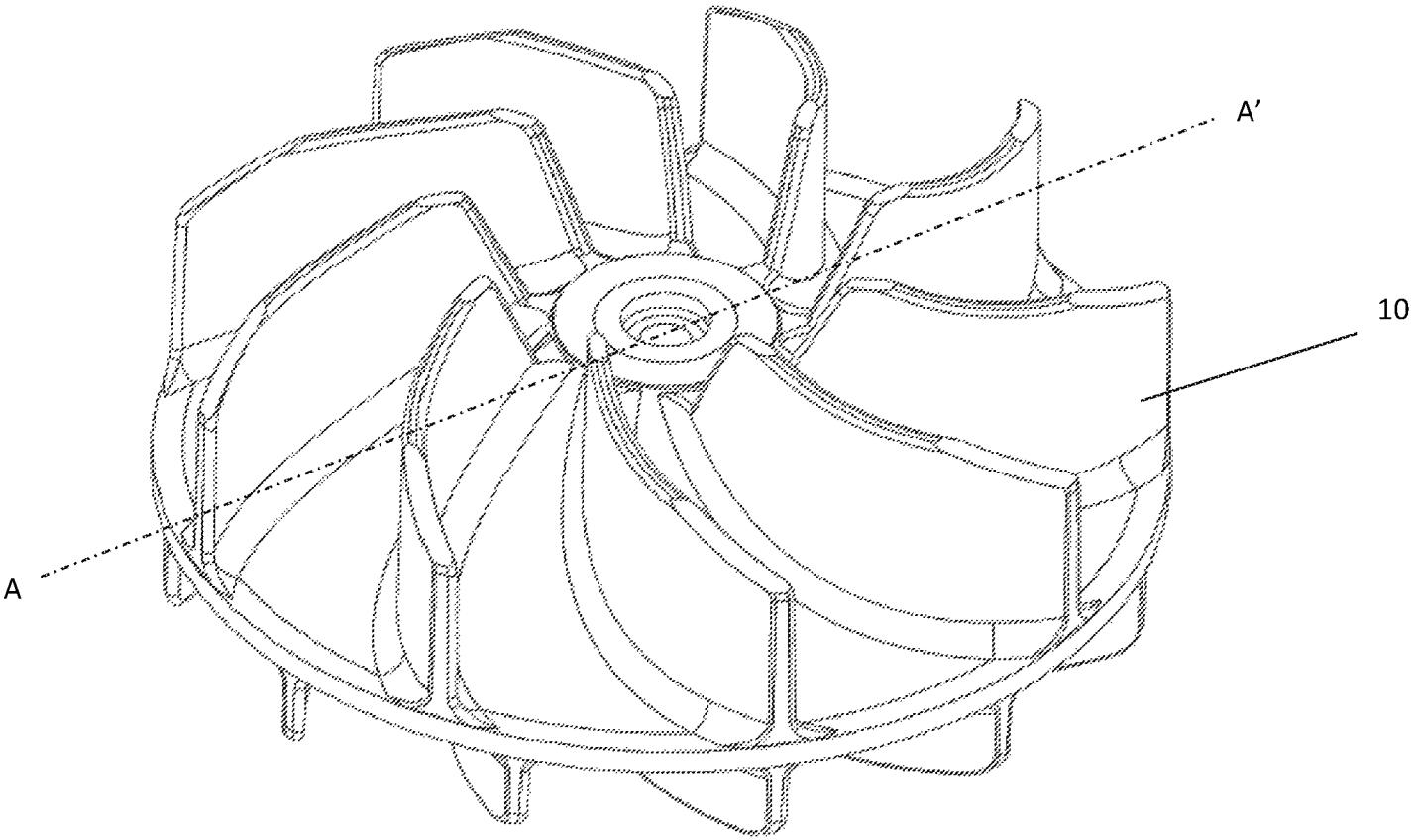
FIG. 1 is a top perspective view of an impeller in accordance with one or more embodiments of the present invention.

The present invention now will be described more fully hereinafter with reference to the accompanying drawings, in which illustrative embodiments of the invention are shown.

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. For example, the terms "imbalance" and "unbalance" are sometimes used interchangeably by those skilled in the relevant art.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. For example, apparatus and methods are described herein with reference to impellers, but the apparatus and methods may be used and applied to any suitable workpiece. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

Items such as impellers, propellers, wheels and other rotating discs are commonly mounted on a shaft. Therefore, there must be a bore through the center of the wheel type object. If the part is rotating at a high speed, for example, 15,000 rpm, the bore must be accurately made, and fitted to the shaft. It would be desirable to machine the bore not only with an accurate fit, but with an accurate location, which exactly coincides with the center of mass of the rotating part. When this is achieved, there will be optimal single plane balance, without any need for further adjustment.

The principle of establishing balance is to align the pivot point, on which the object rests, with a vertical axis which aligns with the center of gravity of the object, and to use this position to establish the boring axis. Workpieces which are amenable to the presently disclosed methods and apparatus are usually disc shaped, in that they have an outer circular periphery and a central boss. Typical impellers and propellers and fans have this feature, and although the fins and vanes disturb the flatness, these features are symmetrical about the central axis about which the part rotates, and it is usually possible to adapt to the special shapes successfully.

Apparatus and methods disclosed herein are operable to define, in a given part or workpiece, a center position of a bore axis in a controlled manner, and to closely guide the boring tools to achieve a bore, which results in a balanced part. In accordance with at least one aspect, methods disclosed herein depend on detecting the tipping action of a workpiece which is resting on a sharp point. Continued incremental readjustment of the workpiece relative to the sharp point in a direction which reduces the offset eventually results in passing the vertical center of gravity line and offsetting in the opposite direction, at which point, the workpiece tips in the opposite direction, therefore indicating that the center of gravity vertical line is within a distance, which is less than the increment adjusted. This then defines the position of the bore axis, if the increment adjusted is based on the imbalance limit specified.

For purposes of non-limiting illustration only the following discussion is provided with reference to a workpiece which is an impeller with a molded-in hub. It will be apparent to those skilled in the art that the devices and methods can be applied to various workpieces.

Figure 2:
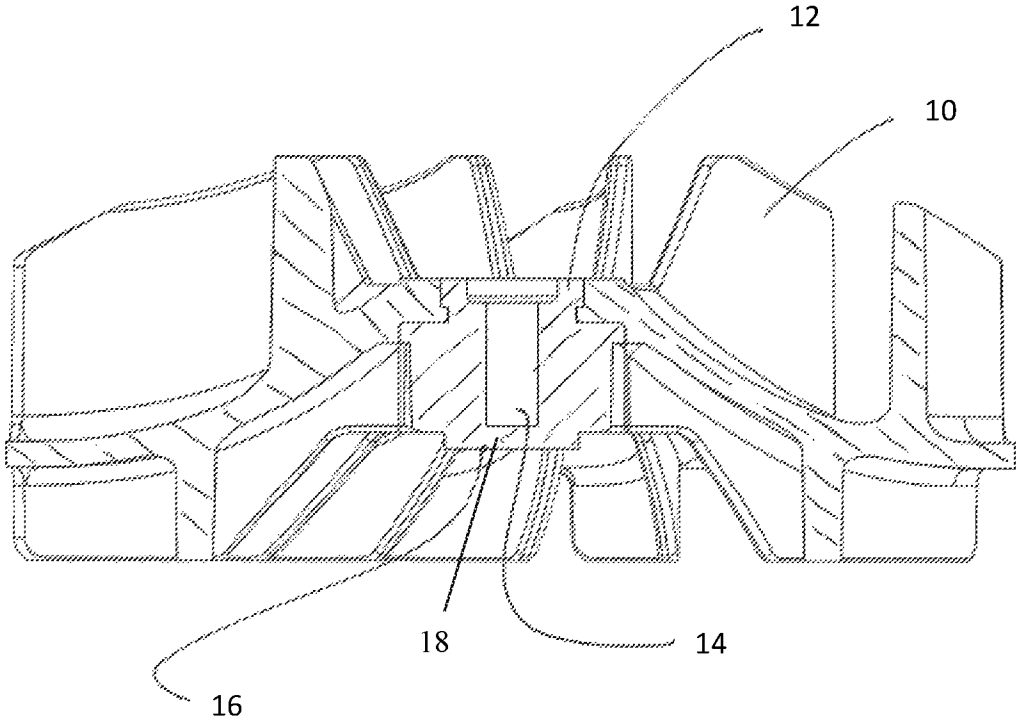
FIG. 2 is a cross-sectional view of the impeller of FIG. 1 taken along line A-A', with an insulating hub, which includes a pre-molded partial bore in accordance with one or more embodiments of the present invention.

Referring to FIGS. 1 and 2 a workpiece 10 (here, an impeller) includes a molded-in hub 12 and a partial bore 14. At the stage of manufacture before boring, the workpiece 10 presents a flat surface below its center of gravity. Hub 12 includes a surface 16 against which a pivot point of a combination pivot point/drilling/reaming tool 200 (see, e.g, FIGS. 6 and 7) may contact. A wall 18 is formed between an end of the partial bore 14 and the surface 16. The surface 16 provides a surface against which the combination pivot point/drilling/reaming tool 200 can be contacted and against which the workpiece 10 can tip, and the wall 18 is designed to be bored through once the center of gravity is in line with the fulcrum.

Figure 3:
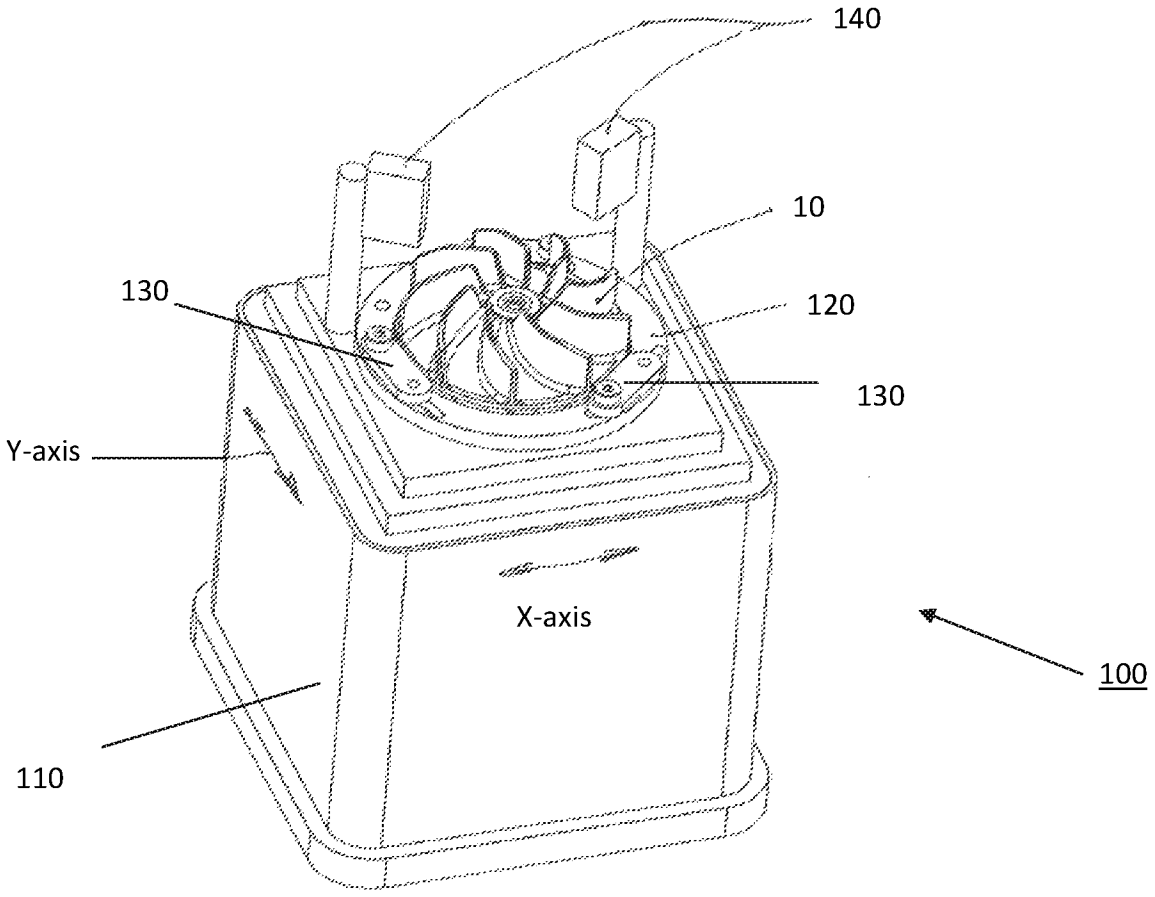
FIG. 3 is a front elevated perspective view of an apparatus operable to locate a center of gravity of a workpiece and form a bore in the workpiece in accordance with one or more embodiments of the present invention.
Figure 3A:
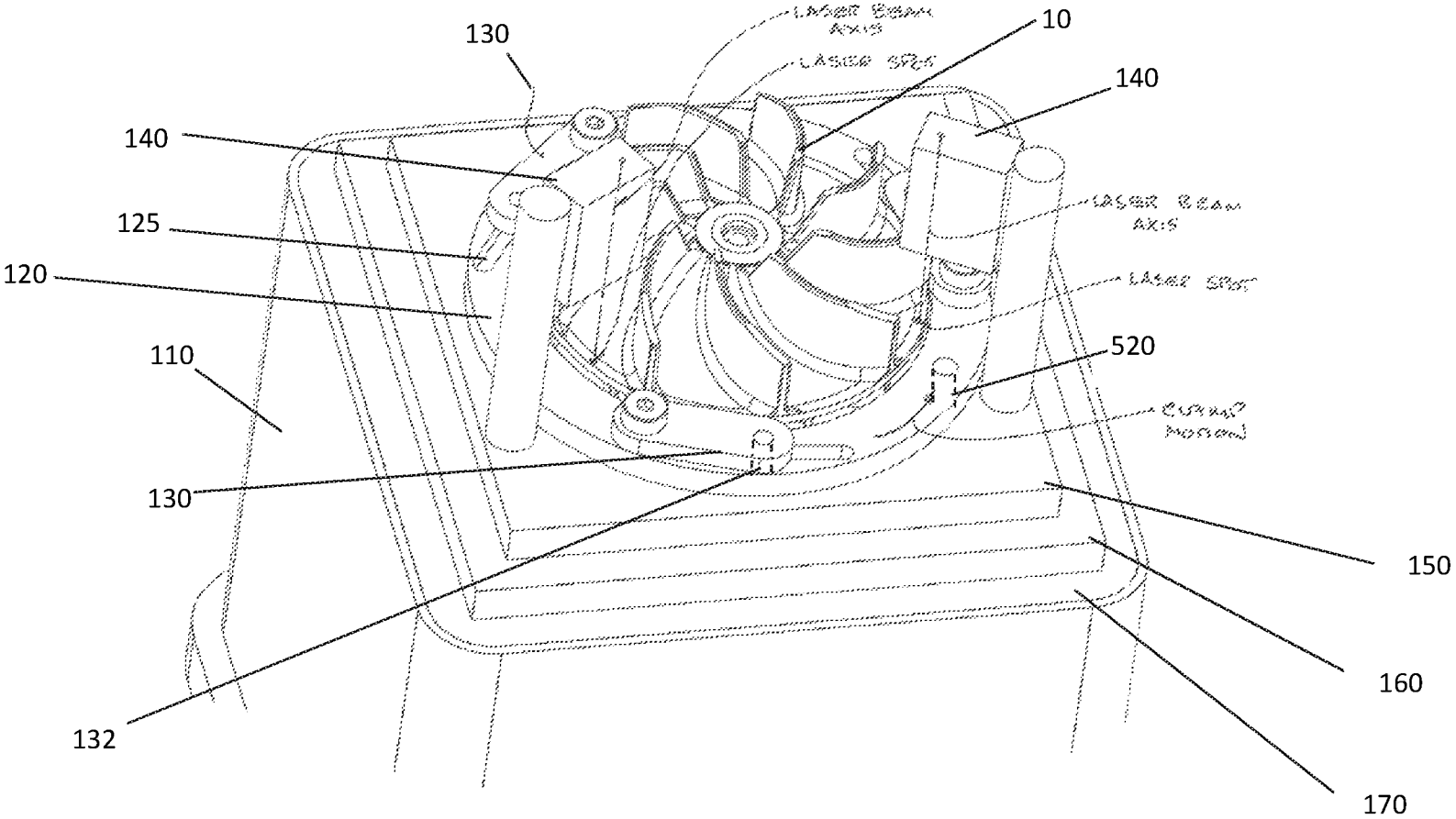
FIG. 3A is a rear elevated perspective view of a portion of the apparatus of FIG. 3 in accordance with one or more embodiments of the present invention.

Now referring to FIGS. 3 and 3A, a combined center of gravity-locating and bore forming apparatus 100 includes a housing 110, a holder 120 for receiving and retaining a workpiece 10, securing means 130 such as one or more clamps or clamping levers, a Y-axis plate 150 coupled on a first side to the holder 120, an X-axis plate 160 with a first side positioned adjacent the Y-axis plate 150 at an opposite side of the Y-axis plate 160, a mounting plate 170 mounted to the housing 110, the mounting plate 170 having a first side positioned adjacent an opposite side of the X-axis plate 160, such that the X-axis plate 160 is sandwiched between the mounting plate 170 and the Y-axis plate 150, distance sensors 140 mounted to Y-axis plate 150 and positioned adjacent the holder 120, a plurality of motors 300, 400, 500, 600 and 700, and a combination pivot point/drilling/reaming tool 200.

The holder 120, which may be a ring having edges within which a workpiece may be retained and centralized, is mounted on the Y-axis plate 150, which in turn is slidably disposed on the X-axis plate 160 which in turn is slidably disposed on the mounting plate 170. Securing means 130 are operable to clamp the workpiece 10 in a fixed position during certain operations of the apparatus 100. Clamps may be any suitable clamps, such as spring-loaded clamps operable to maintain a biasing force on a workpiece positioned in holder 120. In other embodiments the securing means 130 includes clamping levers 130 coupled to holder 120, which is rotatably movable by manual power and/or controlled by a servo motor. In such embodiments, one or more clamping levers 130 are pivotably fixed at a first end to an upper surface of the holder 120 and slidably coupled to a clamping lever aperture 125 at a second end, such as by a post 132 (shown in phantom) extending from a second end of the clamping lever. The holder 120 is rotatably coupled to plate 150, and rotation of the holder 120 in a first direction causes clamping levers to simultaneously clamp the workpiece 10 (shown in the clamped position in FIG. 3A). Rotation of the holder 120 may be performed manually or via a motor linked to the holder 120, as discussed below with further reference to FIG. 5.

Figure 4:
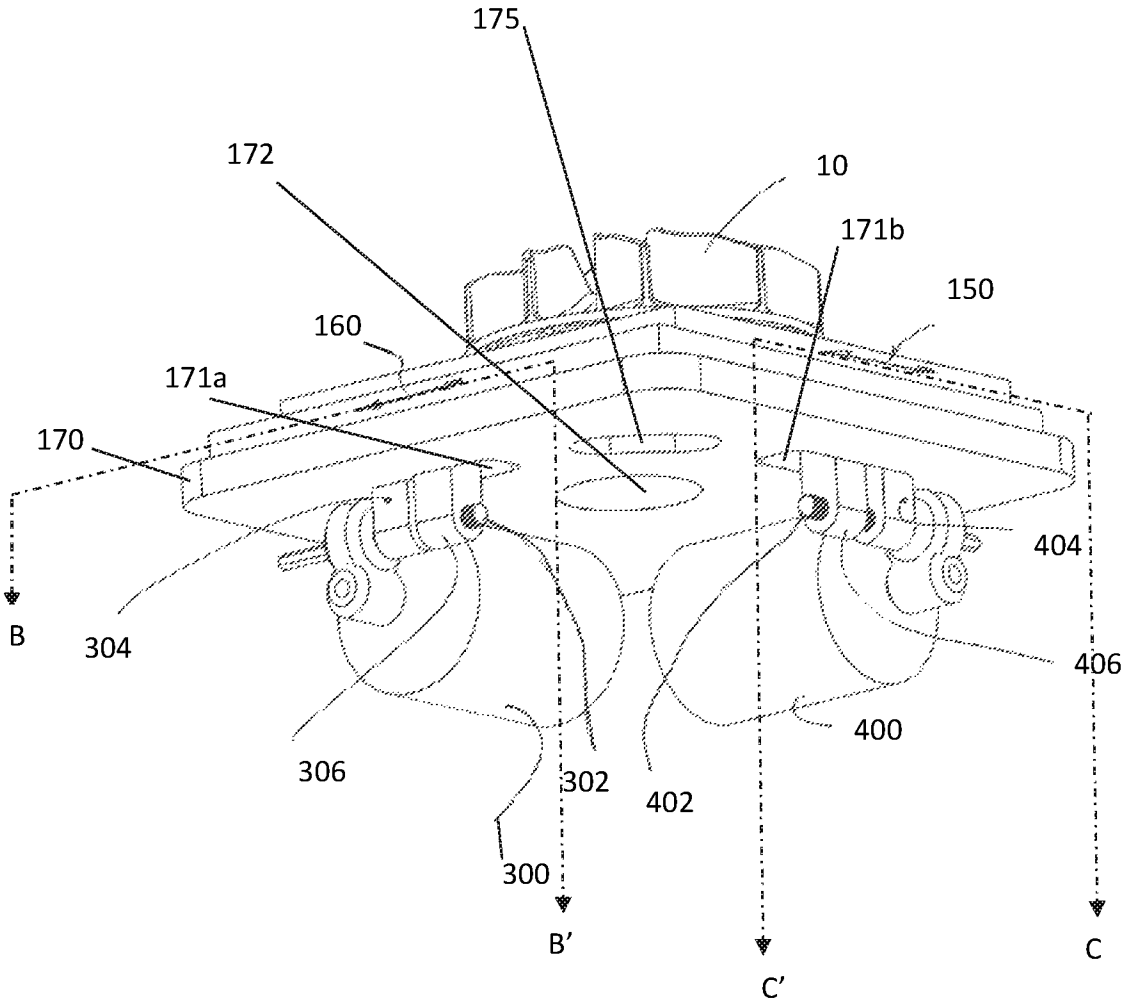
FIG. 4 is a bottom perspective view of the apparatus according to FIG. 3 with the base removed, showing detail of adjustment means for adjusting the workpiece along the X and Y axes in accordance with one or more embodiments of the present invention.
Figure 4A:
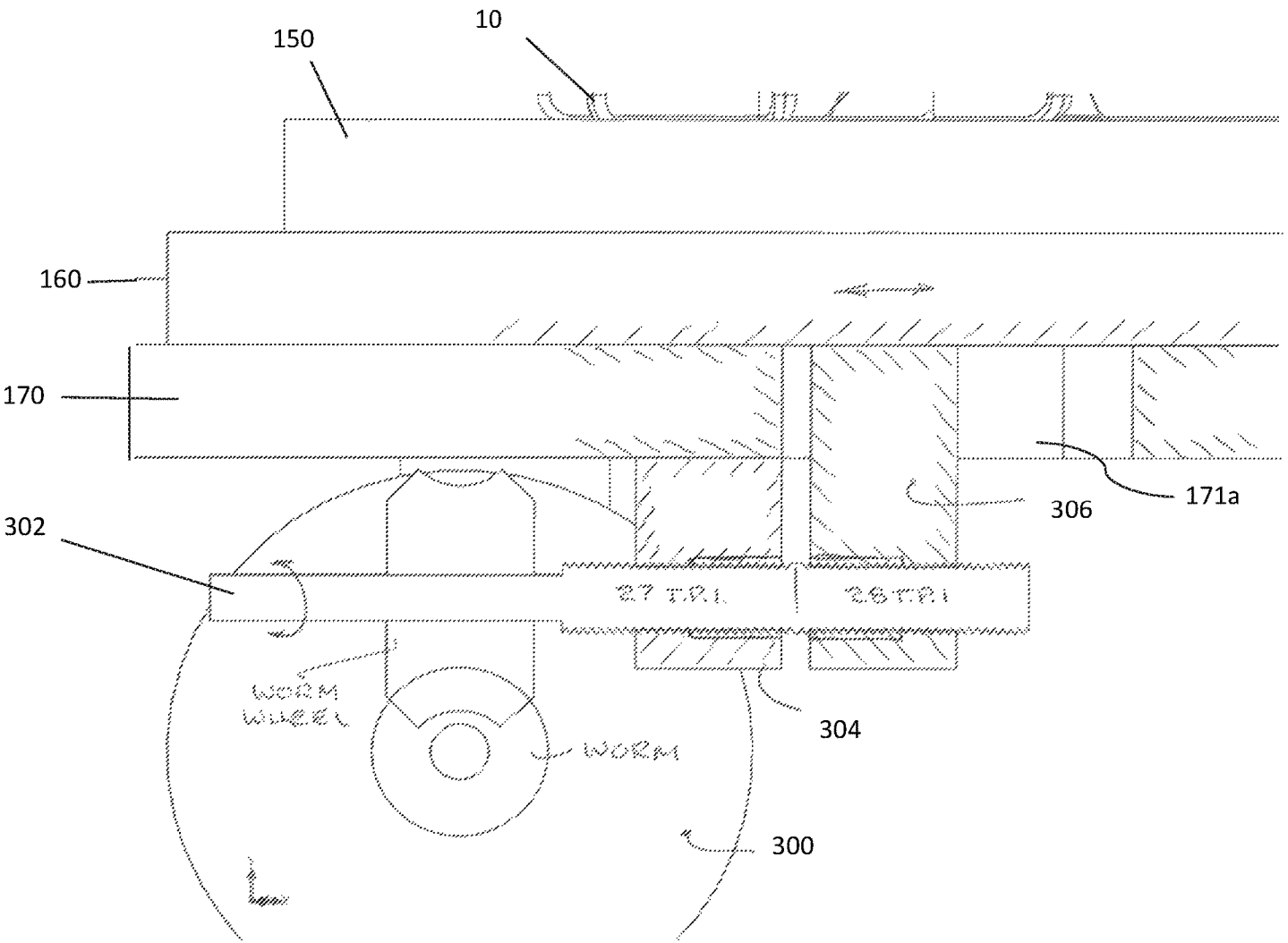
FIG. 4A is a cross-sectional view of plates and a motor of the apparatus according to FIG. 4 taken along line B-B' in accordance with one or more embodiments of the present invention.
Figure 4B:
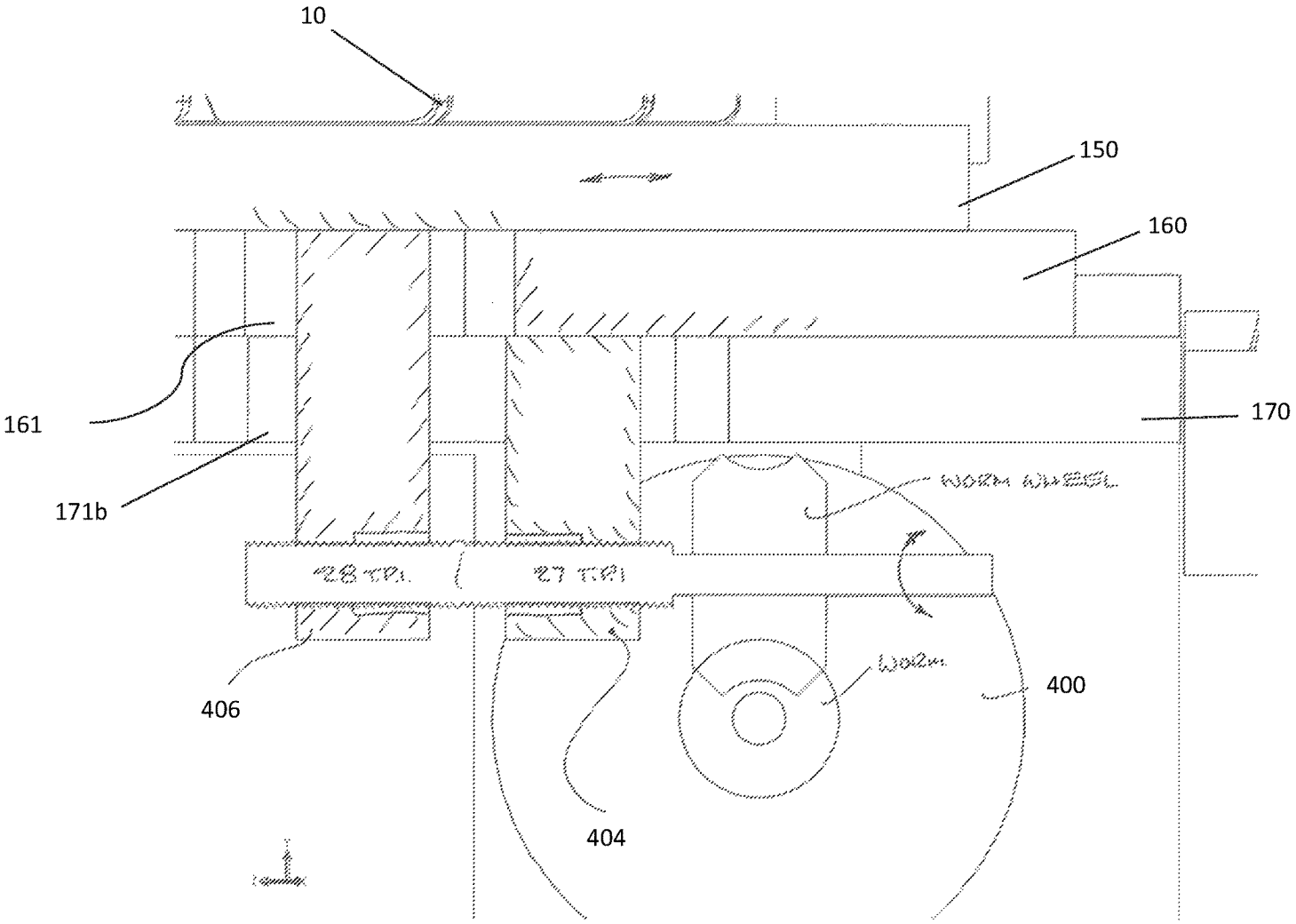
FIG. 4B is a cross-sectional view of plates and a motor of the apparatus according to FIG. 4 taken along line C-C' in accordance with one or more embodiments of the present invention.

With further reference to FIGS. 4-4B, the plates 150, 160 are movable laterally along the Y-axis and X-axis, respectively to permit movement of the workpiece 10 relative to the combination pivot point/drilling/reaming tool 200, described in further detail hereinbelow, which remains fixed, to offset the workpiece 10 an amount and in a direction which precisely compensates the measured imbalance of the workpiece 10. Mounting plate 170 is fixed and mounted to housing 110. Each of the plates 150, 160 and 170 includes a central aperture to accommodate passage of the combination pivot point/drilling/reaming tool 200 therethrough. The central aperture 172 of mounting plate 170 is shown in FIG. 4. The central aperture of each of the plates 150 and 160 is coincident with the central aperture 172 and sized to accommodate movement of the plates 150 and 160 without impinging on or contacting the combination pivot point/drilling/reaming tool 200.

The holder 120 is operable and dimensioned to secure and accurately orient a workpiece 10 so that the ensuing operations of moving the Y-axis and X-axis plates 150 and 160, respectively, and subsequent drilling and reaming will bore in the desired plane of the workpiece 10. The holder 120 is precisely adjustable by virtue of motors 300 and 400 operably linked to the X-axis and Y-axis plates 160 and 150, respectively. Motors 300 and 400 such as but not limited to worm gear motors are operably coupled to screws 302 and 402, respectively, with fine adjustment capability, for example, 27-28 TPI differential, which provide an adjustment of approximately 0.001 inch per turn of the adjustment screws. Suitable motors include but are not limited to Clear-Path® MC PV motors commercially available from Teknic Victor of Victor, N.Y. Motor 300 is coupled to a surface of the mounting plate 170 opposite the X-axis plate. Screw 302 is threadably journaled in brackets 304 and 306. Bracket 304 is coupled to mounting plate 170 and bracket 306 is coupled to X-axis plate 160 through aperture 171*a*, such that rotation of screw 302 upon actuation of motor 300 is operable to move X-axis plate 160 in a desired direction along the X-axis. Motor 400 is coupled to the surface of the mounting plate 170 opposite the X-axis plate. Screw 402 is threadably journaled in brackets 404 and 406. Bracket 404 is coupled to the X-axis plate 160 through aperture 171*b* and bracket 406 is coupled to the Y-axis plate 150 through apertures 171*b* and 161 such that rotation of screw 402 upon actuation of motor 400 is operable to move Y-axis plate 150 in a desired direction along the Y-axis. The sizes of the apertures 171*a*, 171*b* and 161 are adequate to permit required movement of brackets 306, 406, respectively, extending from the adjustment screws 302, 402 and the plates 160, 150 to which the brackets 306, 406 are respectively coupled. Since movements along the X and Y axes are very slight, the clearances between the brackets and the sides of the apertures 171*a*, 171*b* and 161 need only be sufficient to allow for the expected total incremental movements along the X and Y axes, which will typically not be more than 0.10" in any direction for workpieces about the size of a blower impeller. It will be apparent to those of ordinary skill in the art the clearances may be even smaller for smaller workpieces, and larger for larger workpieces.

Figure 5:
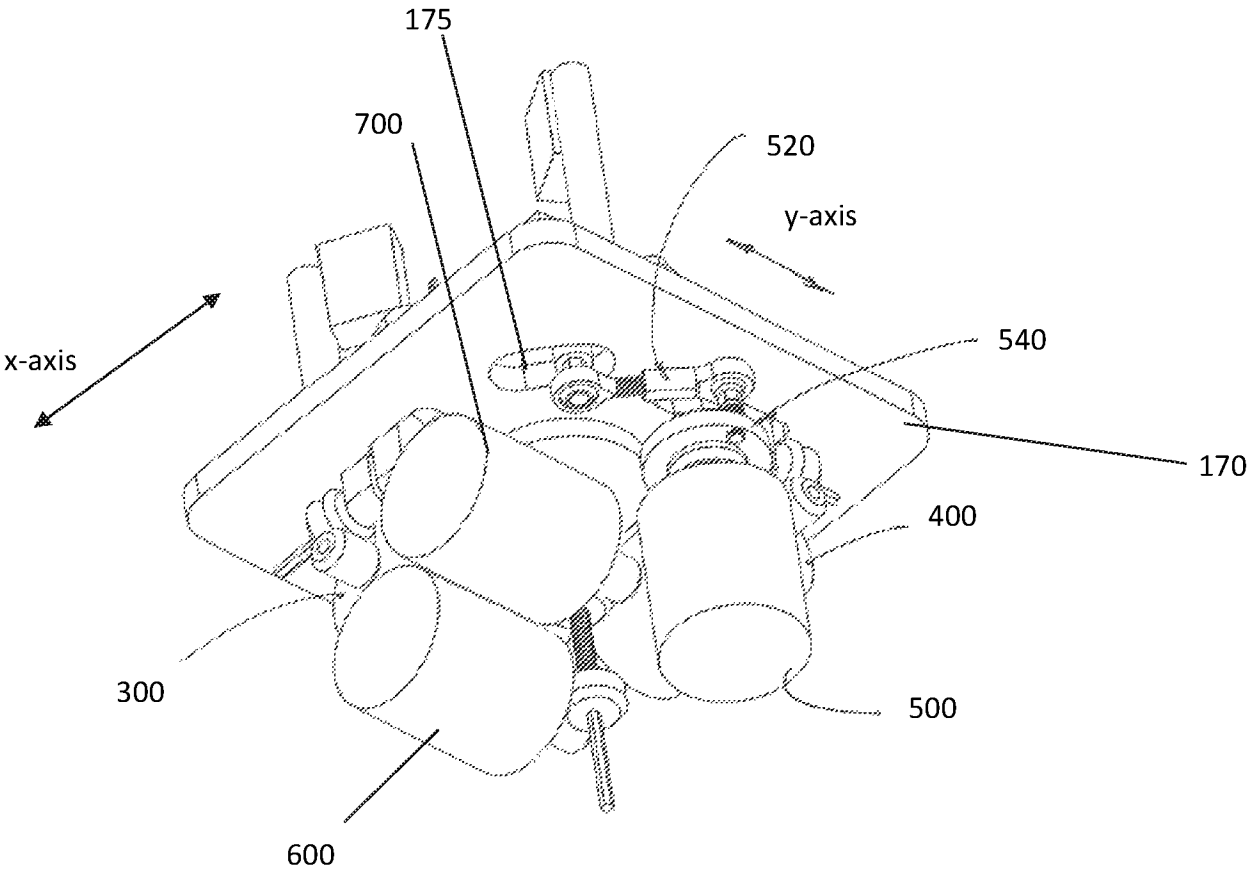
FIG. 5 is a bottom perspective view the apparatus of FIG. 3 with the cover removed and showing a plurality of motors, slip clutch, and a link to a clamping ring in accordance with one or more embodiments of the present invention.

Now with further reference to FIG. 5, in accordance with some embodiments, holder 120 is linked to a clamping motor 500 via linkage 520, through linkage apertures formed in the plates 150, 160 and 170. Motor 500 is operable to apply clamping and unclamping motion to the clamping levers 130. Linkage aperture 175 formed in plate 170 is coincident with similar apertures formed in plates 150 and 160 to permit passage of linkage 520 through plates 150, 160 and 170 to holder 120, the rotation of which is operable to clamp or unclamp a workpiece. The motor 500 is controlled by the need to clamp and unclamp, as dictated in an automatic mode. In some embodiments, the automatic mode can be interrupted, and manual clamping and unclamping may be performed, by an auto/manual selector switch, and/or an on/off switch. A slip clutch 540 may be operably coupled to motor 500 so that a maximum clamping force can be set. When this force is achieved the clutch 540 slips, while the motor 500 maintains the force at low speed. In accordance with other embodiments, other methods known in the art of electrically and electronically maintaining a certain force may be employed, in which case the mechanical slip clutch 540 is not required.

Unclamping, and the resulting free workpiece, is necessary before the pivot point rises and checks the tipping direction. Clamping and withdrawal of the pivot point is necessary to hold the workpiece 10 and allow adjustment of the workpiece 10 position relative to the pivot point. After the procedure of locating the center of gravity of the workpiece 10 within the allowed deviation from the boring axis, the clamping is applied until the drilling and reaming is completed. Then the workpiece 10 is unclamped, to enable removal.

The sensors 140 may be any suitable sensing devices. Suitable laser sensors are available for example from MTI Instruments of Albany, N.Y.

In one embodiment the sensors 140 are laser distance measuring sensors coupled to a computing device running software operable to process measurement information received from the sensors 140 and generate and transmit adjustment information to the motors 300 and 400. With reference to FIG. 3A, in some embodiments, the sensors 140 are positioned relative to the holder 120 such that the laser beams are aimed at points near the periphery of the workpiece 10 at 120 degrees apart around the holder 120. The sensors 140 are oriented such that an imaginary line connecting the laser spots is parallel to what is designated the "X-axis" in FIG. 3, which is coincident with the pivot point. If the sensors 140 are oriented at 120 degrees, the imaginary line connecting the sensors 140 is at approximately half the radius of the workpiece 10. This means that when the readings from the sensors 140 indicate that the distance of each is identical, the tipping direction is coincident with the Y-axis which is perpendicular to the X-axis and coincident with the pivot point. It also means that the readings from sensors 140 are half of the tipping movement at the periphery.

For example, in the case of the impeller mentioned above, the laser sensors 140, after aligning the tipping direction with the Y-axis, could be set to indicate zero. Then if the Y-axis workpiece 10 movement increment is made equal to 'T', which is 0.0023", and progressive increments are made, the workpiece tips in the opposite direction, when center of gravity passes the pivot point. At that point, the laser sensors 140 indicate a 0.020" movement (half of the 2*Z=0.040", total tipping movement). This defines the drilling axis, which becomes the revolving axis.

Figure 6:
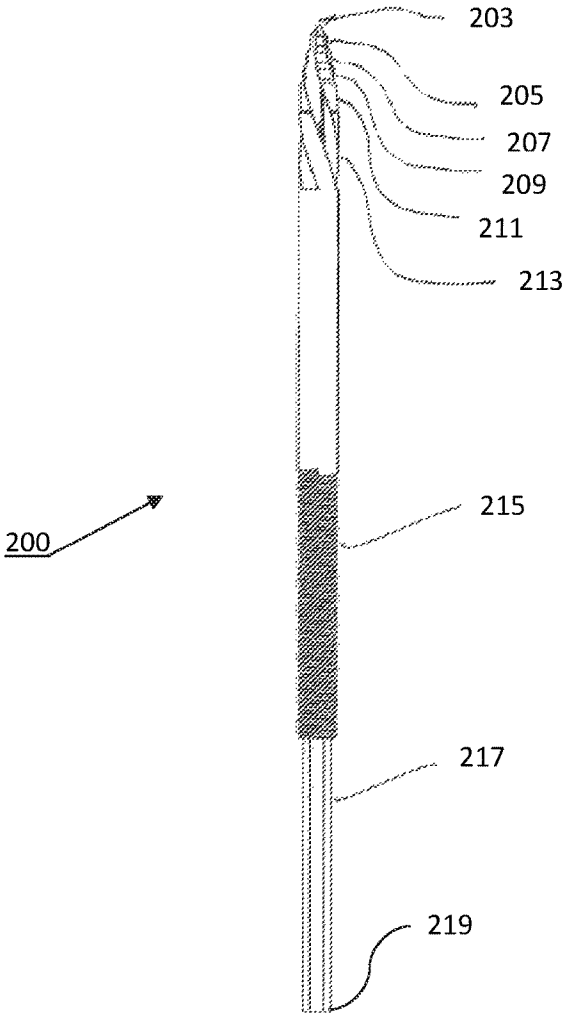
FIG. 6 is a side view of a combined pivot point/drilling/reaming tool in accordance with one or more embodiments of the present invention.

Now referring to FIG. 6, a combination pivot point/drilling/reaming tool 200 includes a pivot point 203 and opposing end 219, drill sections 205, 207, 209 and 211 of increasing gauge, a reamer section 213, a threaded section 215 and a polygonally cross-sectioned section 217 having a, wherein the polygonal cross-section is such as but not limited to a hexagonal cross-section. The combination pivot point/drilling/reaming tool 200 is configured and operable to find the center of gravity, the pivot point 203 acting as a pivot point against the surface 16 of the workpiece, and then drill out the wall 18 shown in FIG. 2, and finish-ream the bore 14 so that the final bore axis coincides with the center of gravity of the workpiece.

Figure 7:
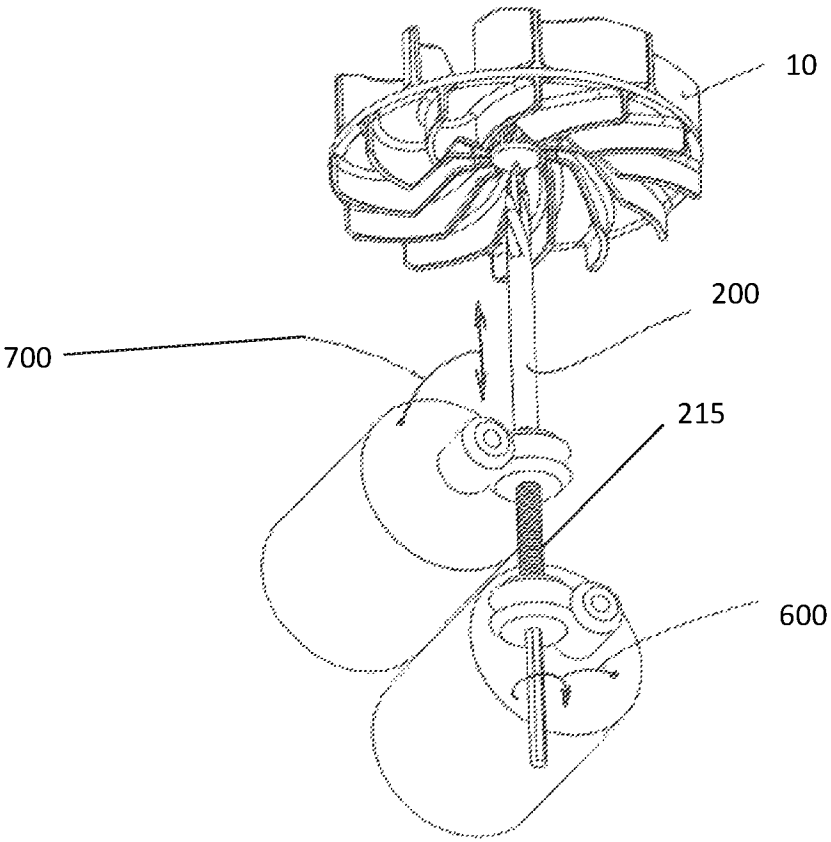
FIG. 7 is a perspective view of selected motors of the apparatus of FIG. 3 engaged with the tool of FIG. 6, which in turn is in contact with a workpiece in accordance with one or more embodiments of the present invention.

Now referring further to FIG. 7, the movement of the tool 200 is controlled by servo motors 600 and 700 operably coupled to the tool 200. Motor 600 is coupled to the polygonally cross-sectioned section 217 and controls the rotation of the tool 200. Motor 700 is coupled to the threaded section 215 of the tool 200 and works in combination with motor 600 to move the tool vertically with respect to the device 100. The orientation of the pivot point 203 of the tool 200 in an upward direction allows the tool 200 to be employed in the balancing operations, and the drill sections 205, 207, 209 and 211 and a reamer section 213 of the tool 200 permit drilling and reaming in the upward direction after the center of gravity is located. Because the tool 200 is used to locate the center of gravity, the tool 200 is automatically in the precise location to conduct boring operations after the center of gravity is identified.

All motors 300, 400, 500, 600 and 700 may be mounted on an interior surface of the housing, or to mounting features within the housing, such as flanges, brackets, etc., employing well-known mounting devices and techniques. As will be apparent to those skilled in the art, the mounting location and the positional orientation of the motors are a matter design choice and may be dictated by considerations such as motor size, model, etc.

Levelling

Before commencing boring and reaming a central bore, the apparatus 100 must be leveled. This must be precise because the methods and apparatus described herein use gravity which acts perpendicular to a level plane. The accuracy of the levelling influences the accuracy of the boring, which will define the imbalance.

The center of gravity is a certain distance above the flat surface 16 of the workpiece 10 onto which the pivot point impinges. It is most desirable to be level enough so that there is no more than a 0.0002" error in position caused by lack of levelness. Ideally, the apparatus 100 is placed on a rigid floor support, such as a heavy bench with a granite surface plate. There are many methods of levelling; in an exemplary embodiment a simple plumb line may be employed. A plumb line can be dropped within the central aperture of plates 150, 160 and 170, and when the gaps formed between the plumb weight and the aperture edges measured are all equal, the apparatus 100 may be deemed level.

In accordance with some embodiments, one or more precision bubble level(s) may be provided on surfaces of the apparatus 100 perpendicular to the drill guiding axis, providing a faster and potentially more controlled apparatus and method. Any perpendicularity machining error will make such measurement incorrect. However, the error will be consistent in amount and direction. This means that if the resulting imbalance is also consistently in error, appropriate compensation in the levelling adjustment can be made. Commercially available precision levels contemplated herein have graduations which indicate 0.0006" per 12" increments. These increments can be noted, and compensation applied, until the imbalance results are acceptable.

Adjustment of the levelling may be accomplished in various ways. In accordance with an exemplary embodiment, levelling screws (not shown) equally spaced around the outer periphery of a base of the apparatus housing 110 may be employed. Balancing and Boring Once the apparatus 100 is levelled and the drilling axis is as close to perfectly vertical as possible, balancing and boring operations can commence using apparatus 100. Balancing operations using the apparatus 100 involve multiple movements of the workpiece relative to the pivot point of tool 200 to find the center of gravity of the workpiece 10.

For purposes of the present disclosure the following symbols and terms are employed. "Z" means and refers to a suitable lifting distance that the workpiece is lifted from a level surface by a pivot point. "U" means and refers to the limit of imbalance expressed as weight distance, e.g. 0.4 gram inches. "W" means and refers to the weight of the workpiece, expressed for example as grams. "T" means and refers to the limiting distance deviation, expressed for example in inches, which combined with workpiece weight gives W×T=U; and T=U/W. "d" means and refers to the increment that the workpiece is moved, usually equal or less than "T".

In connection with the disclosed apparatus, reference to the "X-axis" refers to the axis which is horizontal to the view point when looking down at a workpiece situated on an apparatus as disclosed herein in plan view.

In connection with the disclosed apparatus, reference to the "Y-axis" refers to the axis which is vertical to the view point when looking down at a workpiece situated on an apparatus as disclosed herein in plan view. "Sensor A" is one of two distance sensors 140, and "Sensor B" is the other distance sensor 140.

It is desirable to establish for a particular workpiece the maximum allowable imbalance ("U"). As noted, U is referred to herein as the limit of imbalance. There are standards of acceptable imbalance expressed as mm per second, which apply to and are arranged according to the class of machinery involved. For example, ISO 1940 quality grade G6.3 would apply to hand held blowers. This translates to about 0.25 inches per second. This is hardly ever achieved in commercially available leaf blowers. The present inventor has found that an imbalance of about 0.4 gram-inches of the impeller gives about 0.5 inches per second vibration and is reasonable to handle. Therefore, an imbalance value of 0.4 gram inches is a reasonable goal of the equipment used to make the center bore of a leaf blower impeller.

From this can be calculated the limiting distance deviation "T" the center of gravity can deviate from the revolving axis. As this distance T multiplied by the weight of the workpiece, which is designated as 'W', is the imbalance U, the distance is the imbalance divided by the weight. That is, T=U/W.

In the example of a magnesium impeller for a hand-held blower, which weighs 175 grams, T=0.4/175=0.0023". Thus the deviation of the bore axis, from the center of gravity, must be no more than 0.0023".

In practice, although the imbalance specification can be met quickly with the presently disclosed apparatus and methods, subsequent mounting of the workpiece onto the motor shaft may introduce errors. These errors may come from looseness in the fit, shaft bending, and motor rotor imbalance, etc. So if a good resulting non-vibrating assembly is desired, then it would be wise to tighten the impeller imbalance.

For example, it might not be too troubling to halve the imbalance specification to 0.2 gram inches, in which case U and T are also halved. This increases the examination time, but the total cycle time is still very competitive with the so-called dynamic method.

It will be recognized that the apparatus and methods disclosed herein may be employed in connection with any workpiece that may benefit from balancing, such as impellers of all types, propellers, fans, conveyance wheels and the like, and the values of U, T and Z of each such workpiece can be easily determined using the foregoing formulae.

Detailed Procedural Description

An operator faces the front of apparatus 100 (FIG. 3 being the front view). The tool 200 is engaged to motors 600 and 700 and in axial alignment with the plates 150, 160 and 170 through the central apertures of the respective plates. The pivot point of the tool 200 is set at the lowest position and the clamping levers 130 are in the unclamped position. The 'X'/'PY' position is roughly located, so that the first balance test pivoting causes the workpiece 10 to tip forward towards the operator, and away from the sensors 140.

The operator sets a lifting distance "Z" minimized and suited to the ability of distance sensors 140 to clearly discern tipping.

The two distance sensors 140 are arranged and zeroed so that when sensing downward, they register the same reading when focused on the same level surface. When looking down at a plan view, a straight line connecting Sensor A and Sensor B is aligned parallel to the X-axis.

If sensor readings of the distance of their respective focused point, on the surface, near the outer periphery of a raised, imbalanced and therefore tipped workpiece 10 are unequal, lower and clamp the workpiece 10, and increment the workpiece along the X-axis, in a direction towards the sensor with the lower distance reading, until both sensors are reading identical distances when the workpiece 10 is raised and tipped. This establishes that the tipping direction is parallel to the Y-axis.

In this position, when the workpiece 10 is tipped towards the sensors 140, they will have a higher reading than when the workpiece 10 is tipped away from the sensors 140. When the sensors 140 are registering their high reading, the workpiece 10 is lowered, clamped and incremented along the Y-axis, away from the sensors 140. When the sensors 140 are registering their low reading, the workpiece 10 is lowered, clamped and incremented towards the sensors 140.

If the initial setting of the X- and Y-axis plates 160 and 150 is close to the setting which results in good balance (when checking a batch of identical workpieces, subsequent setting will be close), there should only be need to move the X-axis plate 160 a small increment "d". This could be equal or less than "T".

When the sensors 140 indicate that the tipping direction has changed (by their readings suddenly altering by approximately Z), the workpiece 10 can be lowered and clamped and bored, resulting in a finished bore axis relative to the centroid, within the imbalance limit. A more accurate balance can be achieved if the final increment is reversed in direction and equal to d/2.

All of the motors referred to herein may be computer controlled using software operable to detect measurements from the sensors 140 and perform the operations necessary to move the X- and Y-axis plates 160 and 150, engage and release the clamping levers 130, raise and lower the tool 200 and rotate the tool 200.

Example

In accordance with one embodiment, the balancing and boring procedure may be listed stepwise as follows:

1. The workpiece 10 is placed in the holder 120.
2. The clamps are operated to centralize the workpiece 10.
3. The clamps are released.
4. The tool 200 is raised so that the pivot point 203 contacts the surface 16 of workpiece 10, and lifts the workpiece 10 the distance Z. The workpiece 10 then tips at the periphery the distance Z, and settles in a stable position.
5. The sensors 140 determine how much to move the workpiece along the X-axis so that the laser measurements are equal, and the tipping direction is parallel with the Y axis.
6. The tool 200, and hence the pivot point 203, is lowered so that the pivot point 203 is not in contact with the workpiece 10.
7. The workpiece 10 is centralized and clamped.
8. The movement along the X-axis is performed.
9. The clamps are unclamped.
10. The tool 200 is raised such that the pivot point 203 contacts the surface 16 and lifts the workpiece 10.
11. Steps 5 to 10 are repeated until both laser readings are identical. When they are identical, the operator proceeds to step 12.
12. The tool 200 is lowered so that the pivot point 203 is not in contact with the workpiece 10.
13. The workpiece 10 is clamped.
14. The object is moved a suitable small increment d in a first direction along the Y-axis.
15. The clamps are unclamped.
16. The tool 200 is raised such that the pivot point 203 contacts the surface 16 and lifts the workpiece 10.
17. The sensors 140 check if there is any change. If there is no change, then steps 12 to 17 are repeated. If there is a change, the operator proceeds to step 24; if higher accuracy is required, the operator proceeds to step 18.
18. The tool 200 lowers so that the pivot point 203 is not in contact with the workpiece 10.
19. The workpiece 10 is centralized and clamped.
20. The workpiece 10 is moved along the Y-axis in a direction opposite the direction performed in step 14 d/2.
21. The clamps are unclamped.
22. The tool 200 is raised such that the pivot point 203 contacts the surface 16 and lifts the workpiece 10.

23. The sensors 140 check, and if the reading is clearly indicating a tip in a direction along the Y-axis, steps 18 to 23 are repeated, except at step 20 the workpiece 10 is moved in a direction opposite to the tipping direction d/4. If the tipping becomes unstable, the center of gravity is located. Step 24 is then performed.

24. The tool 200 is lowered so that the pivot point 203 is not in contact with the workpiece 10.

25. The workpiece 10 is securely clamped.

26. The workpiece 10 is drilled and reamed using the tool 200 at the best feed rate as will be apparent to one skilled in the art.

27. The drilling tool 200 is withdrawn (downwards).

28. The drilling tool, apparatus 100 and workpiece 10 are cleaned, such as by blowing air.

29. The finished workpiece 10, having been bored in line with the center of gravity, is unclamped and removed.

Whatever specification for imbalance is set, the tipping distance T can be adjusted and the increment d to suit. The initial offset could be set by a gauge, and the software notes the laser readings and automatically goes back to that reading for each new sample.

Other procedural and software calculations are possible. For example, the software could calculate more directly a combined movement along the X and Y axes to reach the ideal commencing point for the center position search.

It is expected the production cycle is no more than 30 seconds. The placing and removing of the workpieces may be performed by pick and place robotic action.

The presently disclosed apparatus and methods are operable to achieve closer imbalance than 0.4 gram inches. When a bore is machined which is within 0.0012" of perfection, it will clearly place the hand held blower within the G6.3 imbalance grade, and when a bore is machined to within 0.0005" the product will be near the G2.5 grade.

The methods and apparatus described herein have considerable advantages over traditional single plane dynamic balancing, which involves mounting the part on an arbor; running the balancing machine; determining the imbalance; machining the adjustment; rechecking the imbalance; and removal of the part from the arbor.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. An apparatus for locating a center of gravity of a workpiece and forming a bore in the workpiece, the apparatus comprising a housing, the housing comprising a first end forming a base configured to support the apparatus on a surface and a second, opposite end comprising a mounting plate comprising a central aperture, an X-axis plate having a central aperture and a first side, the X-axis plate first side slidably disposed on a first side of the mounting plate opposite a second, base-facing side of the mounting plate, a Y-axis plate having a central aperture and a first side, the Y-axis plate first side slidably disposed on a second, opposite side of the X-axis plate, a holder coupled to a second, opposite side of the Y-axis plate, wherein the holder is configured and operable to receive and retain the workpiece, at least one securing device operable to releasably secure the workpiece in the holder, at least two distance sensors mounted to the Y-axis plate and positioned adjacent the holder, an elongated tool mounted within the housing axially aligned with the central apertures of the mounting plate, Y-axis plate and X-axis plate, wherein the elongated tool is operable to move reciprocally and rotatably, a first motor operably engaged to the Y-axis plate and operable to move the Y-axis plate reciprocally along a first axis, a second motor operably engaged to the X-axis plate and operable to move the X-axis plate reciprocally along a second axis perpendicular to the first axis, a third motor operable to move the elongated tool reciprocally, and a fourth motor operable to rotate the tool.

2. The apparatus of claim 1 wherein the holder comprises a ring rotatably coupled to the Y-axis plate.

3. The apparatus of claim 2 wherein the at least one securing device comprises at least two clamping levers, wherein each of the at least two clamping levers is pivotably fixed at a first end to an upper surface of the holder and slidably coupled at a second end to a clamping lever aperture formed in the holder, wherein rotation of the holder in a first direction causes the clamping levers to simultaneously clamp the workpiece and rotation in an opposite direction causes the clamping levers to release the workpiece.

4. The apparatus of claim 2 further comprising a fifth motor operable to rotate the holder.

5. The apparatus of claim 1 wherein each of the at least two distance sensors are laser sensors spaced apart and each positioned to measure a distance from the sensor to a periphery of the workpiece.

6. The apparatus of claim 5 wherein the at least two distance sensors are spaced apart 120 degrees around a periphery of the holder.

7. The apparatus of claim 1 wherein the elongated tool comprises a first end comprising a pivot point, a threaded region disposed between the first end and a second end, and a polygonally-shaped cross-sectioned region disposed between the threaded region and the second end.

8. The apparatus of claim 7 wherein the elongated tool threaded region is operably coupled to the third motor.

9. The apparatus of claim 7 wherein the elongated tool polygonally-shaped cross-sectioned region is operably coupled to the fourth motor.

10. The apparatus of claim 7 wherein the elongated tool further comprises a plurality of drilling features disposed between the first end and the threaded region.

11. The apparatus of claim 1, wherein the X- and Y-axis plates are movable laterally along the X-axis and Y-axis, respectively to permit movement of the workpiece relative to the elongated tool to offset the workpiece an amount and in a direction which compensates a measured imbalance of the workpiece.

12. A method of locating a center of gravity of a workpiece employing the apparatus of claim 1, the method comprising the steps of A) positioning a workpiece in the holder, B) setting a pivot point of the elongated tool at a position not in contact with the workpiece, C) setting the securing device in an unclamped position, D) raising the elongated tool so that the pivot point contacts the workpiece, causing the workpiece to tip toward an operator and away from the distance sensors, E) setting a lifting distance minimized and suited to the ability of the distance sensors to discern tipping, F) arranging and zeroing the distance sensors so that when the distance sensors are sensing downward, the distance sensors register the same reading when focused on a same level surface, wherein a straight line connecting the at least two sensors is aligned parallel to an x-axis;

G) determining whether readings of distances of the respective distance sensors, with respect to respective focused points, on a surface, proximal the outer periphery of a raised, imbalanced and tipped workpiece are unequal, and if so, lowering and clamping the workpiece, and proceeding to step H); if not, proceeding to step I), H) incrementing the workpiece along the X-axis, in a direction towards the distance sensor which recorded a lower distance reading than the other distance sensor, until both distance sensors are reading identical distances when the workpiece is raised and tipped, to establish the tipping direction is parallel to the Y-axis, I) lowering the elongated tool to lower the workpiece, J) securing the workpiece, K) incrementing the workpiece along the Y-axis, either toward or away from the distance sensors depending on the direction of tipping away from the sensors;

L) when the sensors indicate that the tipping direction has changed, lowering the elongated tool, M) clamping the workpiece, and N) drilling the workpiece using the elongated tool.

* * * * *